US008528681B2

(12) United States Patent
Fujiwara et al.

(10) Patent No.: US 8,528,681 B2
(45) Date of Patent: Sep. 10, 2013

(54) BONNET SEALING STRUCTURE FOR WORK MACHINE

(75) Inventors: Junichi Fujiwara, Osaka (JP); Katsuhiko Yukawa, Izumi (JP)

(73) Assignee: Kubota Corporation, Osaka (JP)

( * ) Notice: Subject to any disclaimer, the term of this patent is extended or adjusted under 35 U.S.C. 154(b) by 951 days.

(21) Appl. No.: 12/561,709

(22) Filed: Sep. 17, 2009

(65) Prior Publication Data

US 2010/0122862 A1 May 20, 2010

(30) Foreign Application Priority Data

Nov. 17, 2008 (JP) ..... 2008-293491

(51) Int. Cl.
*B62D 25/12* (2006.01)

(52) U.S. Cl.
USPC ..... 180/69.2; 180/69.24

(58) Field of Classification Search
USPC ..... 180/69.2, 69.24
See application file for complete search history.

(56) References Cited

U.S. PATENT DOCUMENTS

| | | | | |
|---|---|---|---|---|
| 5,671,820 | A * | 9/1997 | Kobayashi et al. | 180/68.1 |
| 6,405,825 | B1 * | 6/2002 | Yabe et al. | 181/204 |
| 6,565,148 | B1 * | 5/2003 | Teramoto et al. | 296/192 |
| 6,626,256 | B2 * | 9/2003 | Dennison et al. | 180/69.24 |
| 6,634,449 | B2 * | 10/2003 | Randolph | 180/69.24 |
| 7,188,865 | B2 * | 3/2007 | Sugiyama et al. | 280/759 |
| 7,401,672 | B2 * | 7/2008 | Kurtz et al. | 180/68.4 |
| 7,481,289 | B2 * | 1/2009 | Ueda et al. | 180/89.16 |
| 7,717,218 | B2 * | 5/2010 | Matsumoto et al. | 180/291 |
| 7,828,097 | B2 * | 11/2010 | Kondou et al. | 180/68.1 |
| 8,083,019 | B2 * | 12/2011 | Fujita et al. | 180/291 |
| 8,240,415 | B2 * | 8/2012 | Okada et al. | 180/89.17 |
| 2004/0188166 | A1 * | 9/2004 | Sugiyama et al. | 180/291 |
| 2005/0210717 | A1 * | 9/2005 | Ueda et al. | 37/443 |
| 2005/0210718 | A1 * | 9/2005 | Ueda et al. | 37/466 |
| 2006/0108309 | A1 * | 5/2006 | Sato et al. | 212/232 |
| 2010/0122862 | A1 * | 5/2010 | Fujiwara et al. | 180/69.2 |
| 2010/0236855 | A1 * | 9/2010 | Matsushita et al. | 180/69.2 |

FOREIGN PATENT DOCUMENTS

| | | |
|---|---|---|
| CN | 1676784 A | 10/2005 |
| JP | 2004150029 | 5/2004 |
| JP | 2005280485 | 10/2005 |

* cited by examiner

*Primary Examiner* — Jeffrey J Restifo
(74) *Attorney, Agent, or Firm* — The Webb Law Firm

(57) ABSTRACT

A bonnet sealing structure for a swiveling work machine includes: a bonnet configured to cover an engine provided on a swivel stage including: a fixed cover, and an open-close cover which is swingably supported about a vertical shaft and is openable and closable relative to the fixed cover; a sealing member through which an upper end portion of the open-close cover is brought into contact with an upper end portion of the fixed cover when the open-close cover is closed; and a cover piece protruding from one of an upper wall of the open-close cover and an upper wall of the fixed cover, wherein when the open-close cover is closed, the cover piece is located above the sealing member and reaches a point above the other of the upper wall of the fixed cover and the upper wall of the open-close cover.

6 Claims, 16 Drawing Sheets

BONNET SEALING STRUCTURE FOR WORK MACHINE

BACKGROUND

The present invention relates to a bonnet sealing structure of a swiveling work machine, such as backhoe.

In a conventional swiveling work machine, such as backhoe, on a rear portion of a swivel stage is mounted an engine, which is covered with a bonnet. The bonnet is formed of front, left and rear covers for covering front, left and rear sides of the engine, respectively, and the like. The front cover and the left cover are fixed to a support frame or the like straddling the engine. The rear cover is made openable and closable relative to the front cover; the rear cover is supported by the support frame or the like openably and closably about a vertical shaft as a fulcrum shaft on one end in a transversal direction of the rear cover (for example, see Japanese patent application JP2005-280485A).

With respect to this type of conventional bonnet structure for swiveling operation, a sealing structure disclosed in, for example, Japanese patent application JP2004-150029A is applied thereto as-is, and generally, an upper end portion of the rear cover (open-close cover) is brought into contact with an upper end portion of a fixed cover through a sealing member, when the rear cover is closed.

Therefore, in the conventional structure, snow or soil may be accumulated on the sealing member between the upper end portion of the fixed cover and the upper end portion of the open-close cover, and if snow or soil becomes frozen, the sealing member and the portions of the cover in the vicinity thereof may become fixed in an attached state.

Therefore, it would be desirable to provide a structure in which snow or soil is prevented from being accumulated on a sealing member between the upper end portion of the fixed cover and the upper end portion of the open-close cover.

SUMMARY OF THE INVENTION

In one aspect of the present invention, there is provided a bonnet sealing structure for a swiveling work machine including: a bonnet configured to cover an engine provided on a swivel stage including: a fixed cover, and an open-close cover which is swingably supported about a vertical shaft and is openable and closable relative to the fixed cover; a sealing member through which an upper end portion of the open-close cover is brought into contact with an upper end portion of the fixed cover when the open-close cover is closed; and a cover piece protruding from one of an upper wall of the open-close cover and an upper wall of the fixed cover, wherein when the open-close cover is closed, the cover piece is located above the sealing member and reaches a point above the other of the upper wall of the fixed cover and the upper wall of the open-close cover.

In the bonnet sealing structure, it would be preferable that the cover piece is provided on the upper wall of the open-close cover, and is provided with a suspended piece protruding downward from a base portion of the cover piece, a standing piece is provided on an end portion of the upper wall of the fixed cover, that stands opposite to the suspended piece and is positioned below the cover piece when the open-close cover is closed, and the sealing member is provided on one of the suspended piece and the standing piece, and is brought into contact with the other of the suspended piece and the standing piece when the open-close cover is closed.

It would be also preferable that the engine and a radiator are mounted on a rear portion of the swivel stage, a support frame straddles the engine, the fixed cover configured to cover upper and front sides of the engine is fixed to the support frame, the open-close cover configured to cover a rear side of the engine is supported by the support frame in such a manner that the open-close cover is freely opened and closed about the vertical shaft as a fulcrum shaft on one end in a transversal direction of the open-close cover, the open-close cover includes a cover main body; and an upper cover body which is fixed to an upper end portion of the cover main body and protrudes frontward, and the upper cover body includes the upper wall on which the cover piece and the suspended piece are provided.

It would be still preferable that a partition cover configured to separate a space around the radiator into an upstream-side space and a downstream-side space in terms of an air flow direction is fixed to the support frame so as to extend along a free end portion in the transversal direction of the open-close cover, the partition cover includes: a top wall; and a rear wall protruding downward from a rear end of the top wall, on a free end portion of the upper cover body, an upper sealing member is provided which is brought into contact with the top wall of the partition cover when the open-close cover is closed, and on a free end portion of the cover main body, a rear sealing member is provided which is brought into contact with the rear wall of the partition cover when the open-close cover is closed.

It would be still preferable that a downward protrusion protrudes downward from a protruding end portion of the cover piece, and the standing piece is positioned below the cover piece and on a suspended piece side relative to the downward protrusion, when the open-close cover is closed.

BRIEF DESCRIPTION OF THE DRAWINGS

The various aspects, other advantages and further features of the present invention will become more apparent by describing in detail illustrative, non-limiting embodiments thereof with reference to the accompanying drawings.

DETAILED DESCRIPTION OF PREFERRED EMBODIMENTS

Figure 1:
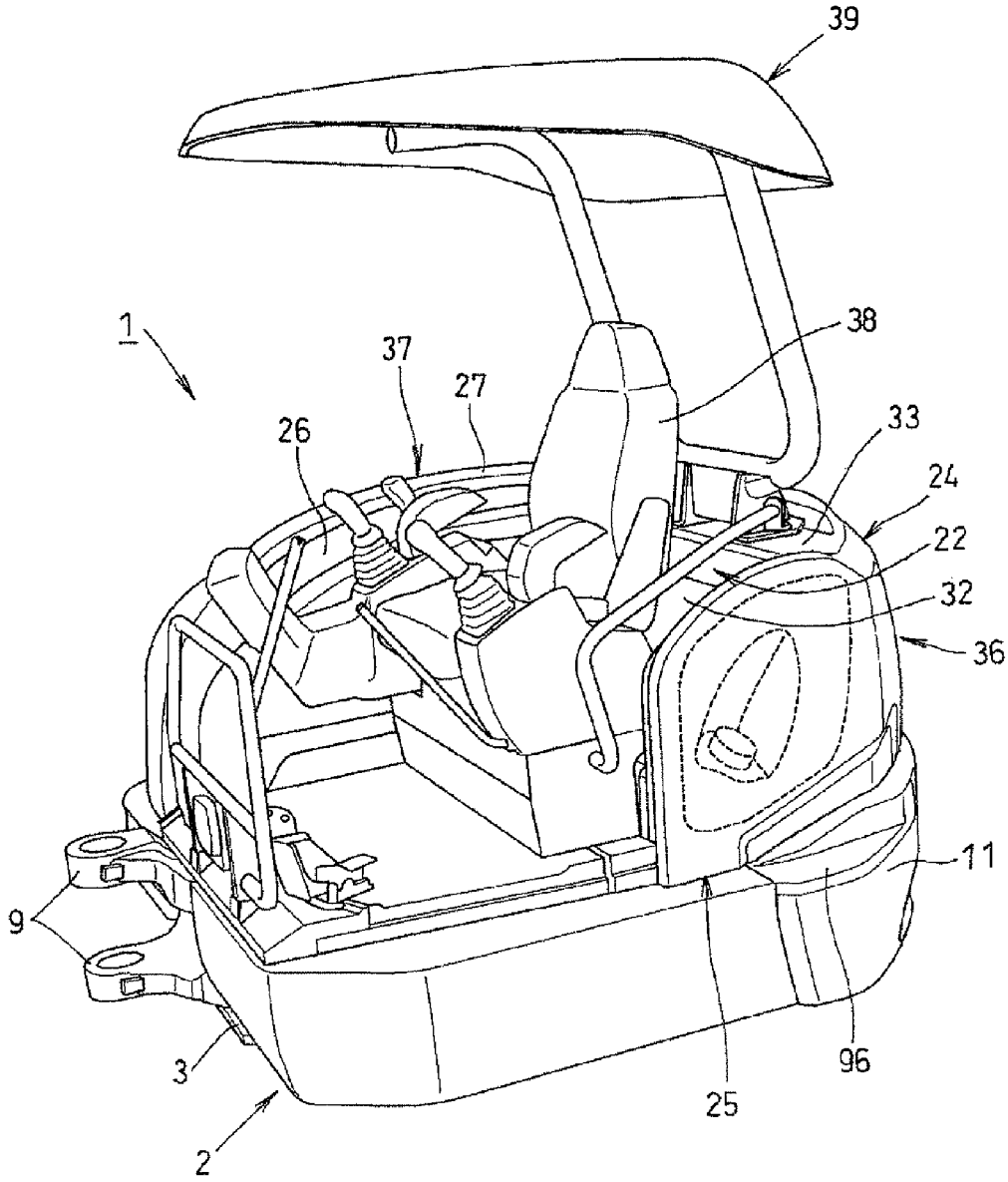
FIG. 1 is a perspective view of an upper portion of a backhoe according to one embodiment of the present invention.

Hereinbelow, embodiments of the present invention will be described with reference to the accompanying drawings.

As shown in FIGS. 1 to 4, a backhoe 1 as one example of a swiveling work machine includes a traveling device with a pair of right and left crawler track traveling bodies (not shown), and a swivel stage 2. The swivel stage 2 is mounted above the traveling device through a swivel bearing, rotatably about a swivel shaft center extending in a vertical direction.

The swivel stage 2 includes a swivel base 3 in a shape of a plate and a vertical wall 5 partitioning a space above the swivel base 3 into front and rear spaces. The vertical wall 5 stands on the swivel base 3 in an intermediate portion thereof in a longitudinal direction. The swivel base 3 is provided with a pair of right and left longitudinal ribs 6,7 which are away from each other from a front side to a rear side of the swivel base 3. On a front side of a pair of the right and left longitudinal ribs 6,7, a bracket 9 is provided so as to protrude frontward from the swivel base 3. Through the bracket 9, a working device for excavation is installed on a front end portion of the swivel stage 2.

A rear end portion of the swivel base 3 is provided with a counter weight 11. Frontward of the counter weight 11 in the rear end portion of the swivel base 3, a mounting wall 12 in a shape of an arc protrudes upward. Frontward of the mounting wall 12 in the rear end portion of the swivel base 3, an engine 14 is disposed. On a left portion of the swivel base 3, a fuel tank is disposed, and on a right portion of the swivel base 3, a battery and an oil tank are disposed. The fuel tank is arranged frontward of the vertical wall 5 and on an immediate left side of the left longitudinal rib 6. The battery and oil tank are arranged frontward of the vertical wall 5 and on a right side of the right longitudinal rib 7.

In this manner, on a rear side of the vertical wall 5 of the swivel stage 2 is formed an engine room 20. The engine 14, a radiator 15 and the like are mounted on a rear portion of the swivel stage 2, and a hydraulic pump 16 is disposed on a left side of the engine 14.

Figure 5:
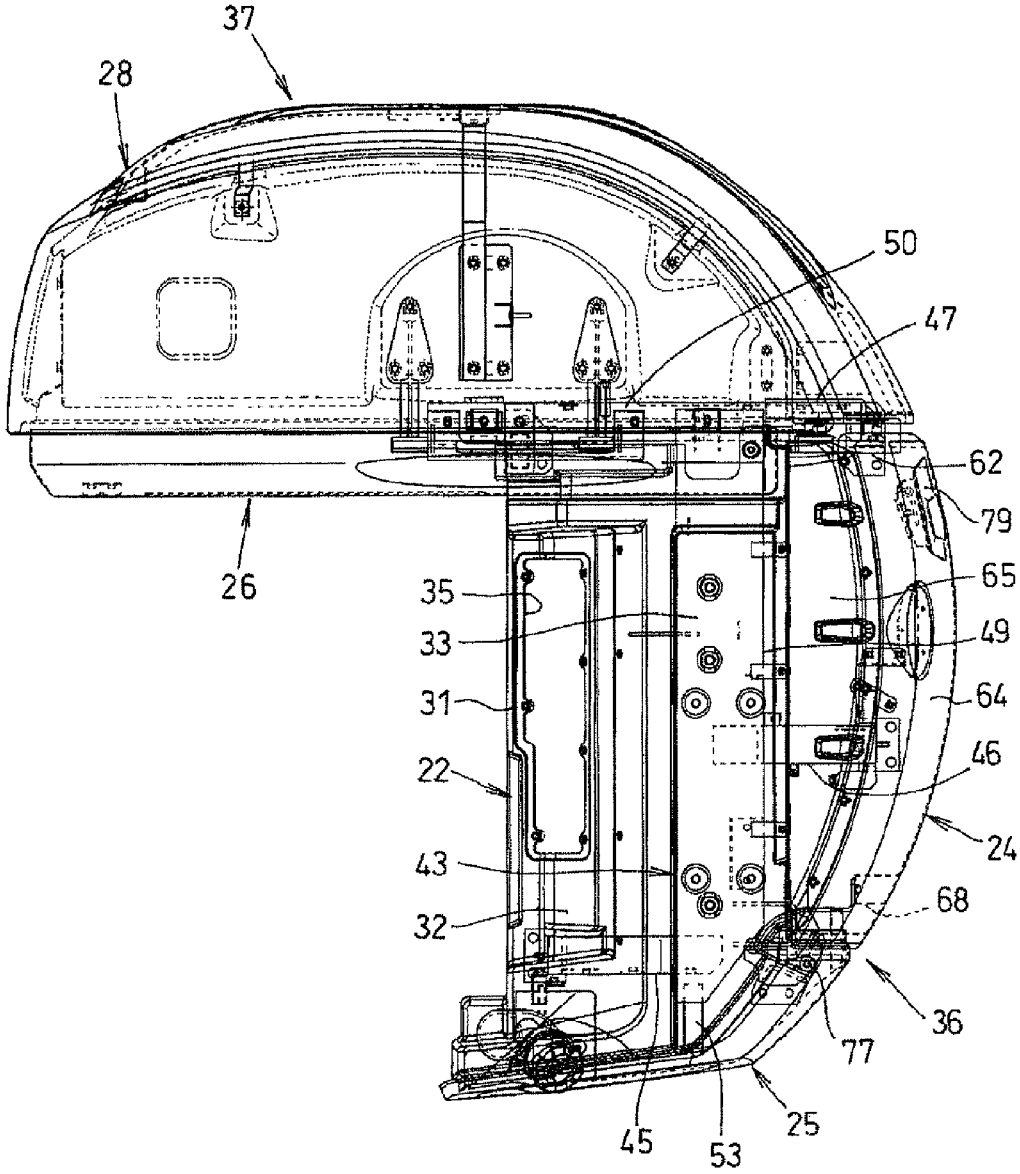
FIG. 5 is a plan view of an upper portion of the swivel stage.
Figure 6:
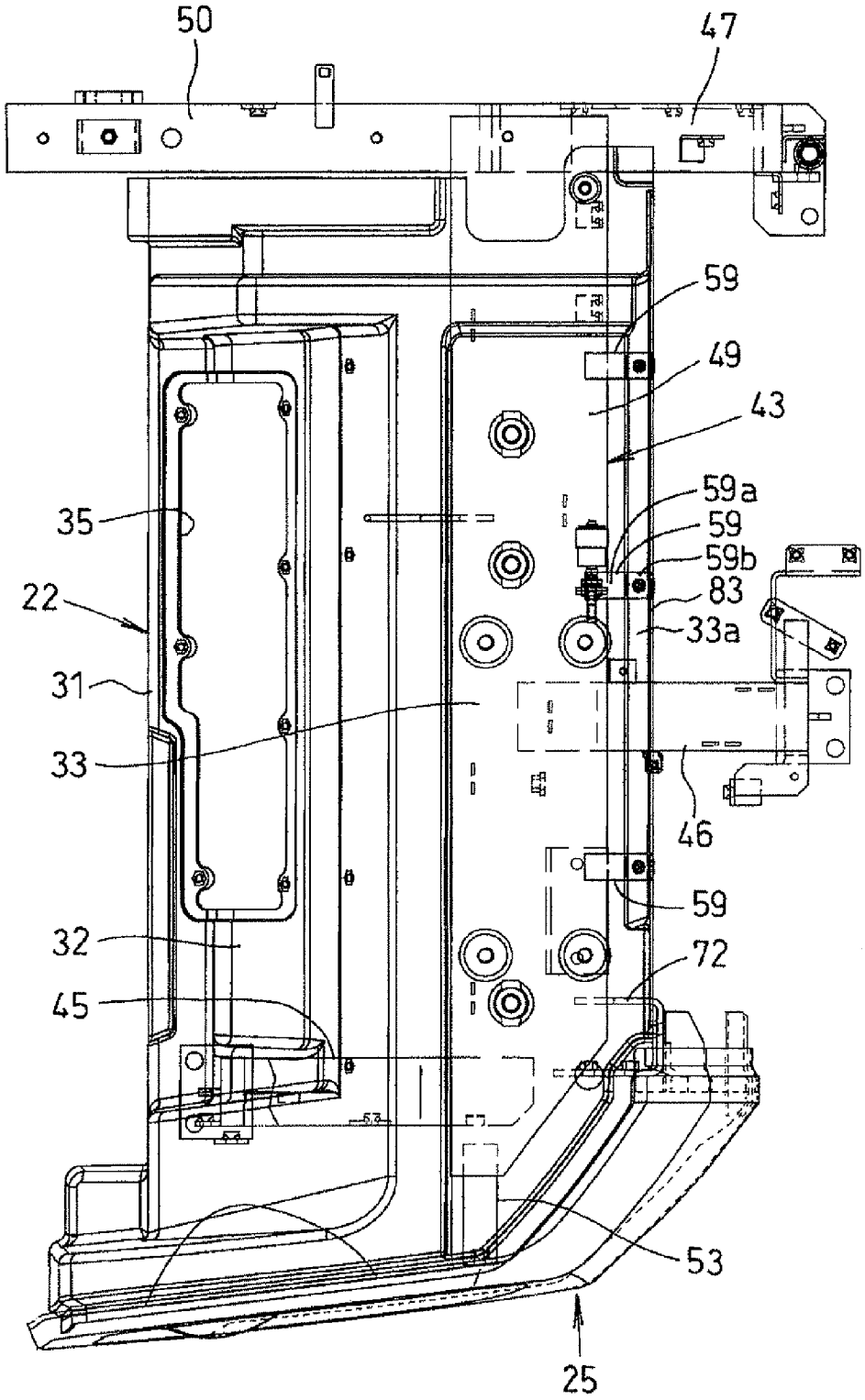
FIG. 6 is a plan view of a portion of the rear bonnet of the swivel stage.
Figure 7:
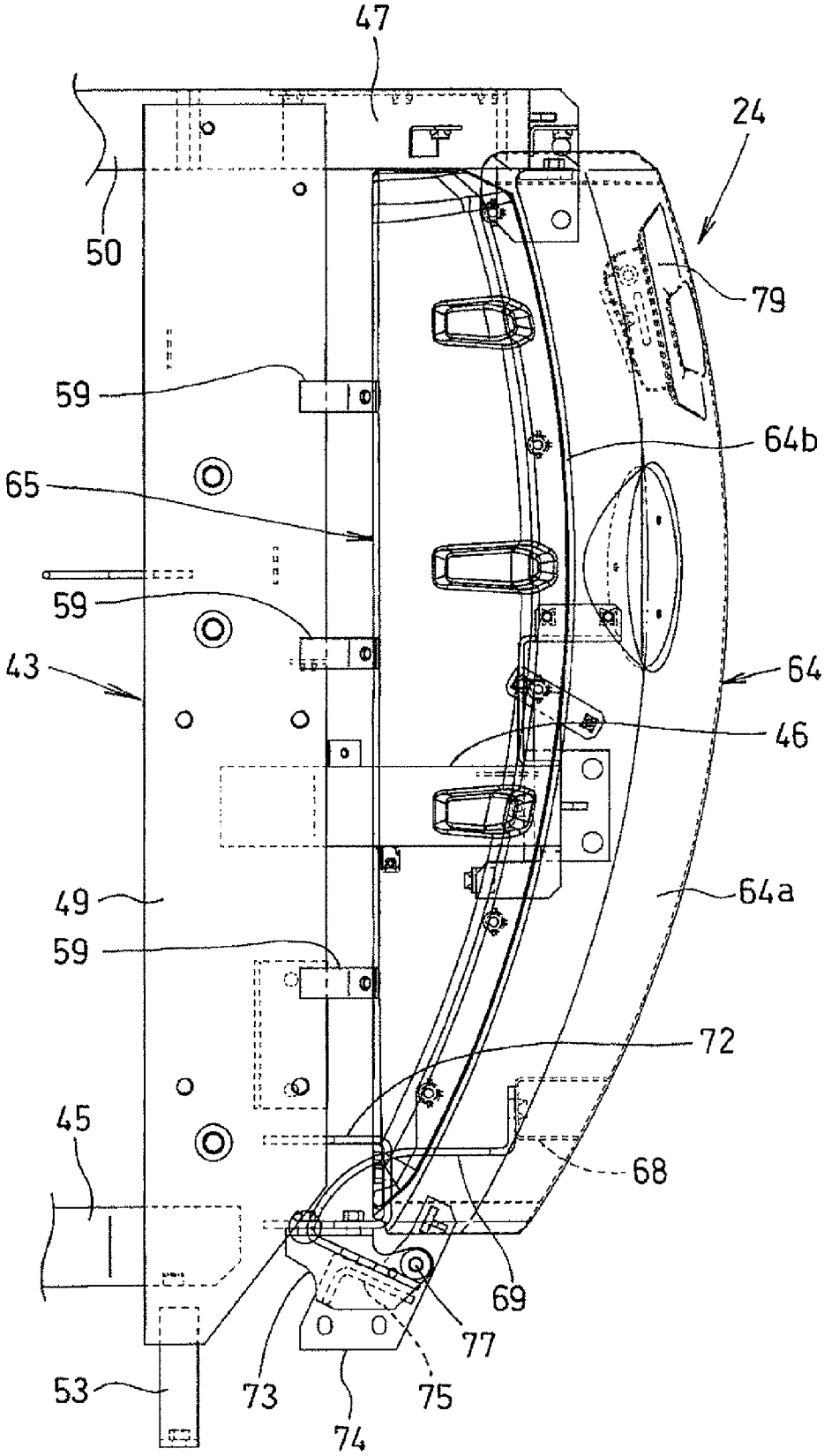
FIG. 7 is a plan view of a portion of a rear cover of the swivel stage.
Figure 8:
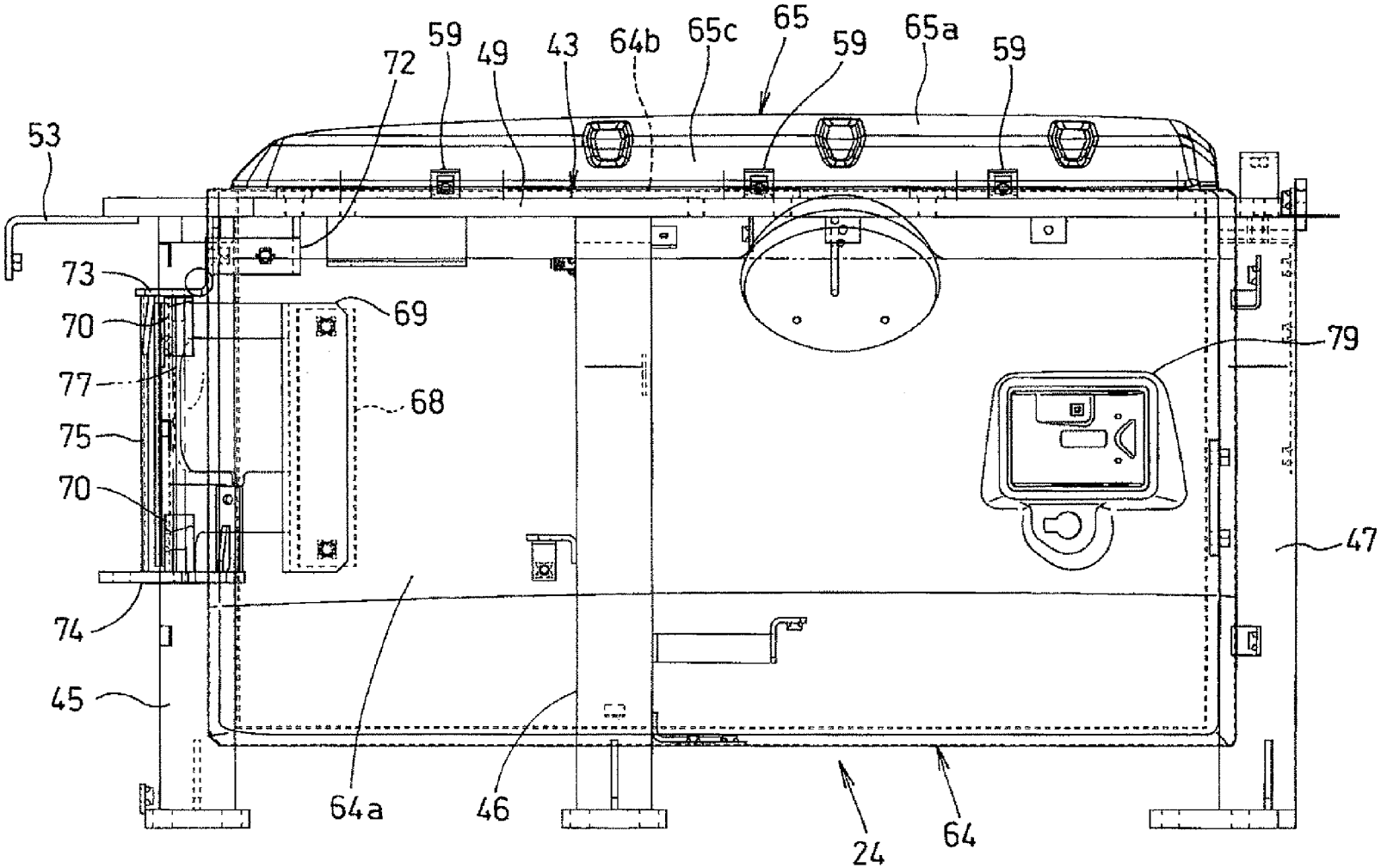
FIG. 8 is a rear view of a portion of the rear cover of the swivel stage.
Figure 9:
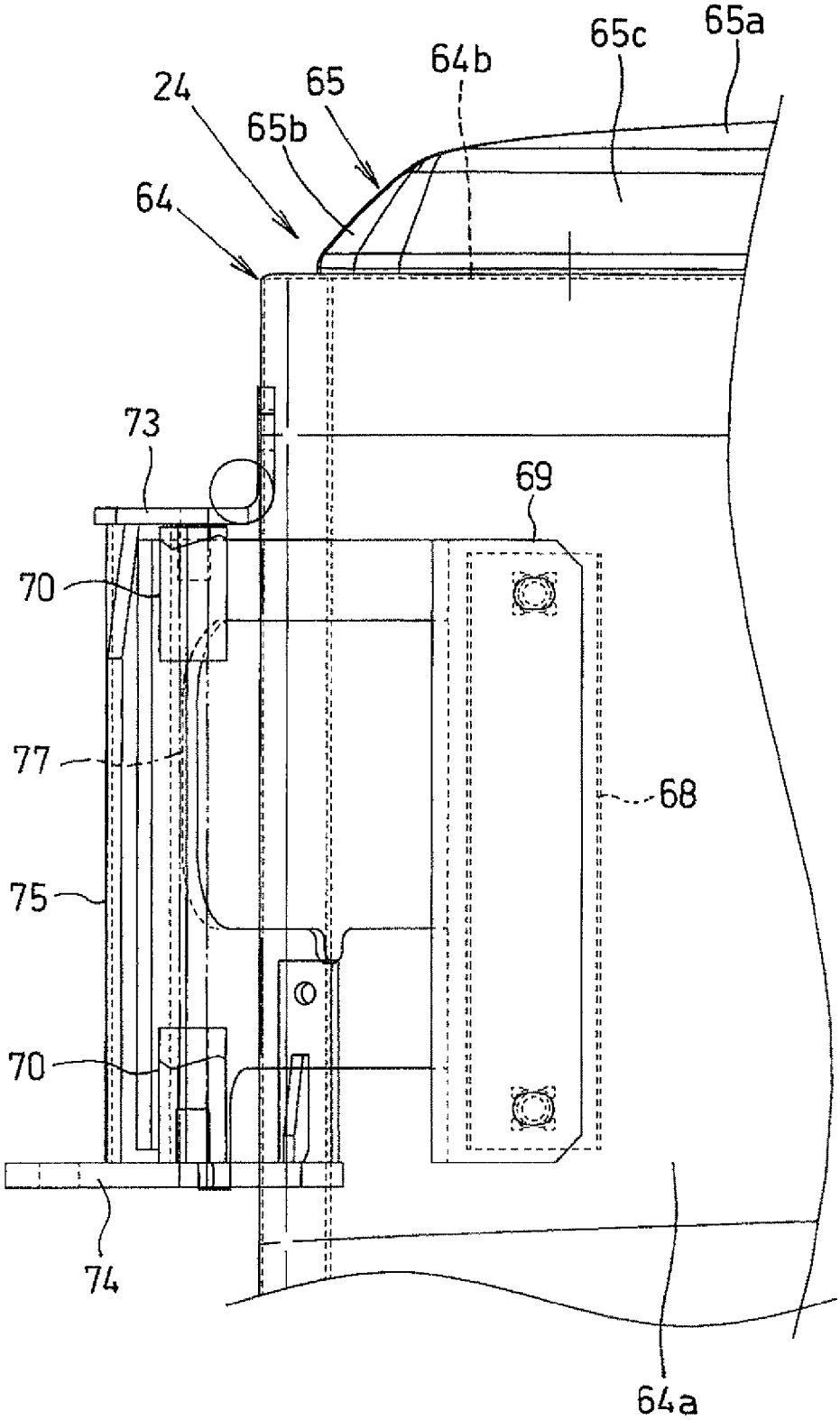
FIG. 9 is a rear view of a left end portion of the rear cover of the swivel stage.
Figure 10:
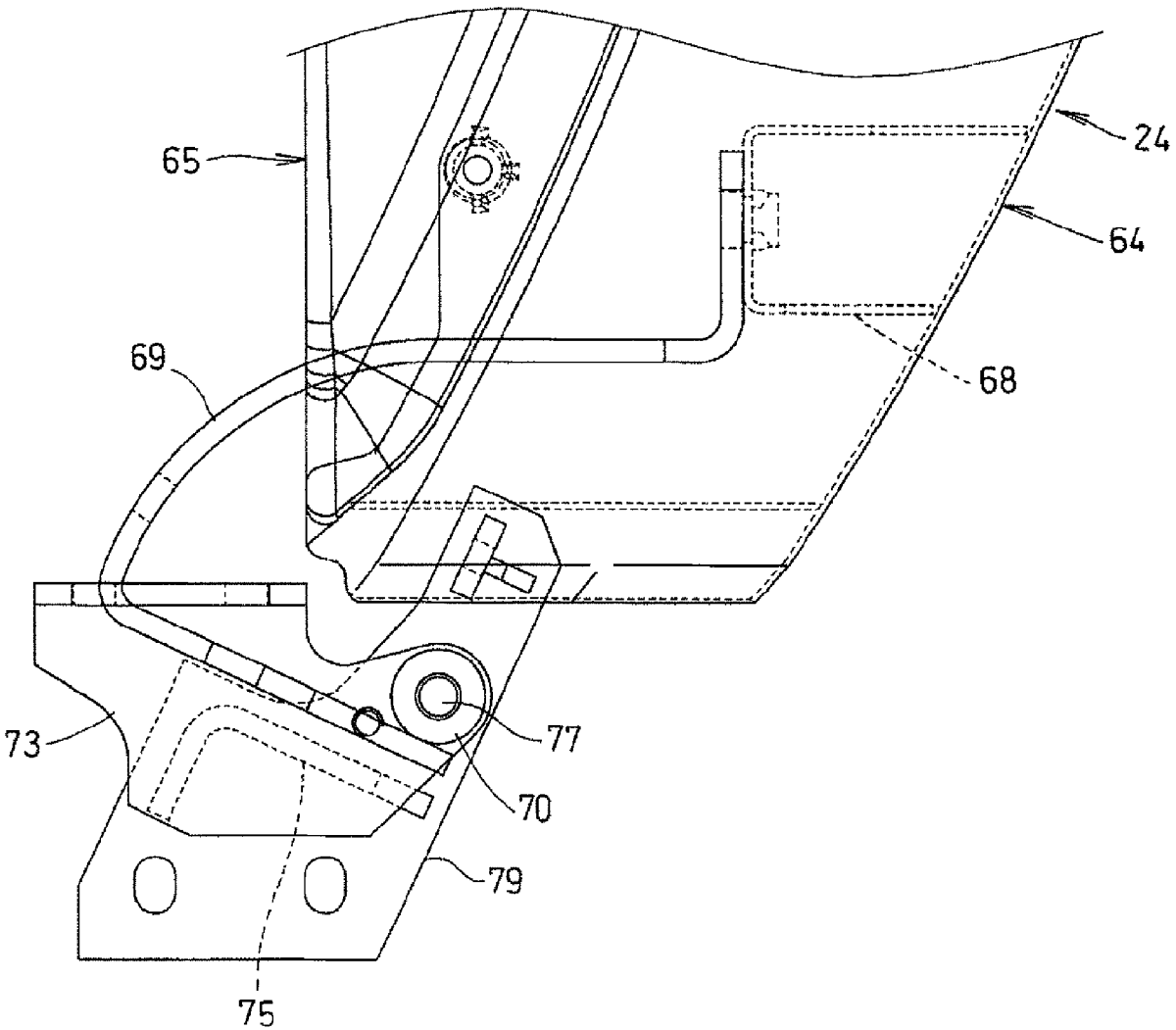
FIG. 10 is a plan view of the left end portion of the rear cover of the swivel stage.

As shown in FIG. 5, frontward of the engine 14 on the swivel stage 2, a front cover 22 is provided which is configured to serve as a partition on a front side of the engine room 20. A lower end portion of the front cover 22 is fixed to the vertical wall 5 with fixtures, such as bolt. A rear cover 24 is provided on a rear end portion of the swivel stage 2, a left cover 25 is provided on a left side of the rear cover 24 on the swivel stage 2, a right inner wall cover 26 is provided on a right side of the front cover 22 on the swivel stage 2, and a right cover 28 is provided on a right side of the right inner wall cover 26 on the swivel stage 2.

The front cover 22 includes: a standing wall 31 as a lower front end portion of the front cover 22; an inclined wall 32 extending rearward and upward from an upper end of the standing wall 31; and an upper wall 33 extending rearward from an upper end of the inclined wall 32. A lower portion of the standing wall 31 overlaps an upper end portion of the vertical wall 5, and fixed to the vertical wall 5 with fixtures, such as bolt and nut. On the inclined wall 32 of the front cover 22, an opening window 35 for inspection purpose is provided, which is closed with a detachable lid member (not shown).

The rear cover 24 is disposed above the counter weight 11. The counter weight 11 and the rear cover 24 together cover a rear side of the engine room 20. The left cover 25 covers a left side of the engine room 20. The vertical wall 5 and the front cover 22 together cover the front side and an upper side of the engine room 20. A rear portion of the right cover 28 covers a right side of the engine room 20. In this manner, the vertical wall 5, the front cover 22, the left cover 25, a rear portion of the right cover 28, the counter weight 11 and the rear cover 24 together surround the engine 14 (the engine room 20). The right cover 28 covers a right side of the devices on the swivel stage 2, such as battery and oil tank, and the right side of the engine room 20. The right cover 28 also covers front, upper and outer side portions of a right front area of the swivel base 3 where the devices, such as battery and oil tank, are mounted. The right inner wall cover 26 covers an inner side portion of the right front area of the swivel base 3 where the devices, such as battery and oil tank, are mounted.

A rear bonnet 36 is formed of the front cover 22, the left cover 25, the rear portion of the right cover 28 and the rear cover 24, and a side bonnet 37 is formed of the right cover 28 and the right inner wall cover 26.

Figure 2:
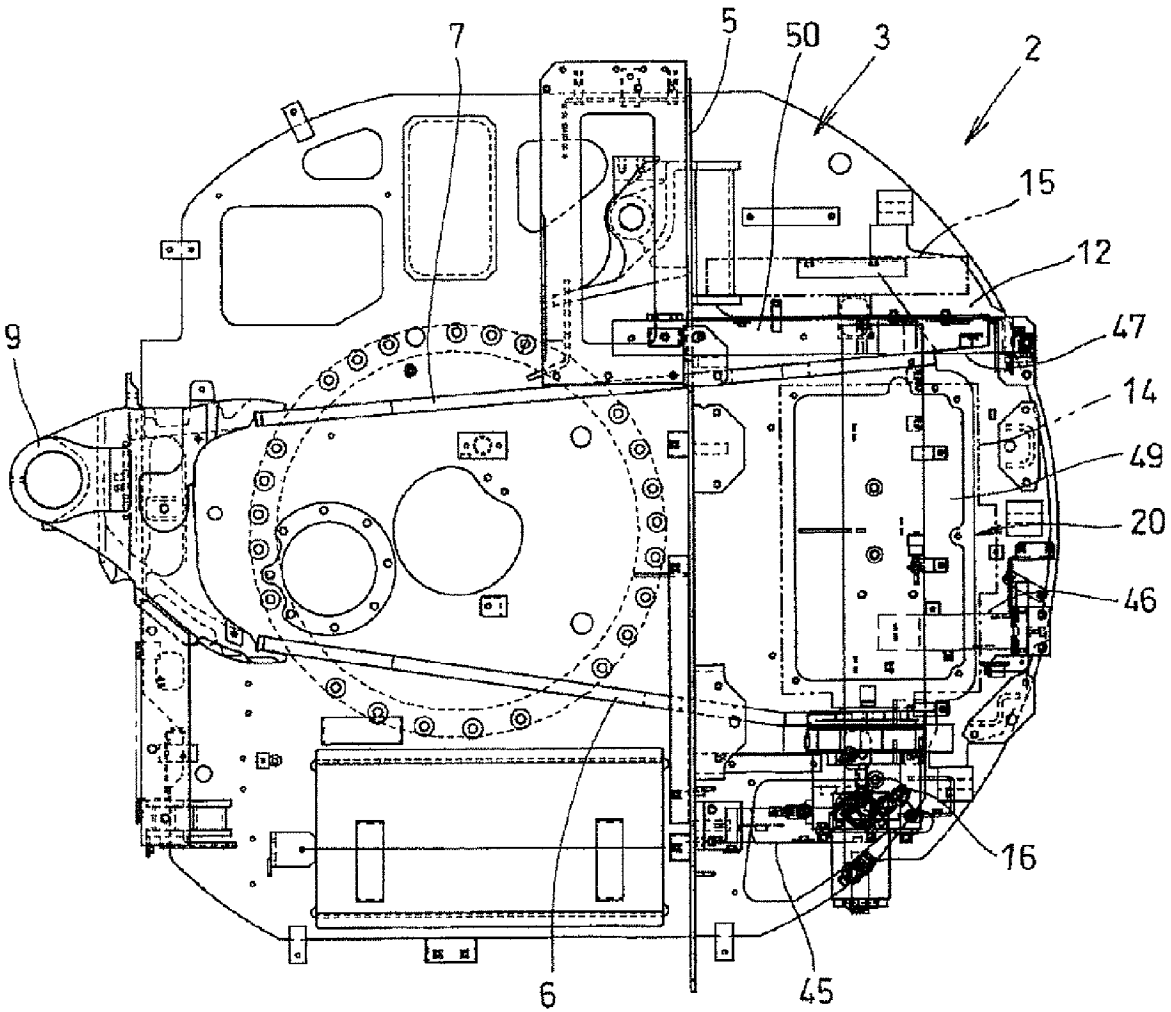
FIG. 2 is a plan view of a swivel stage.
Figure 3:
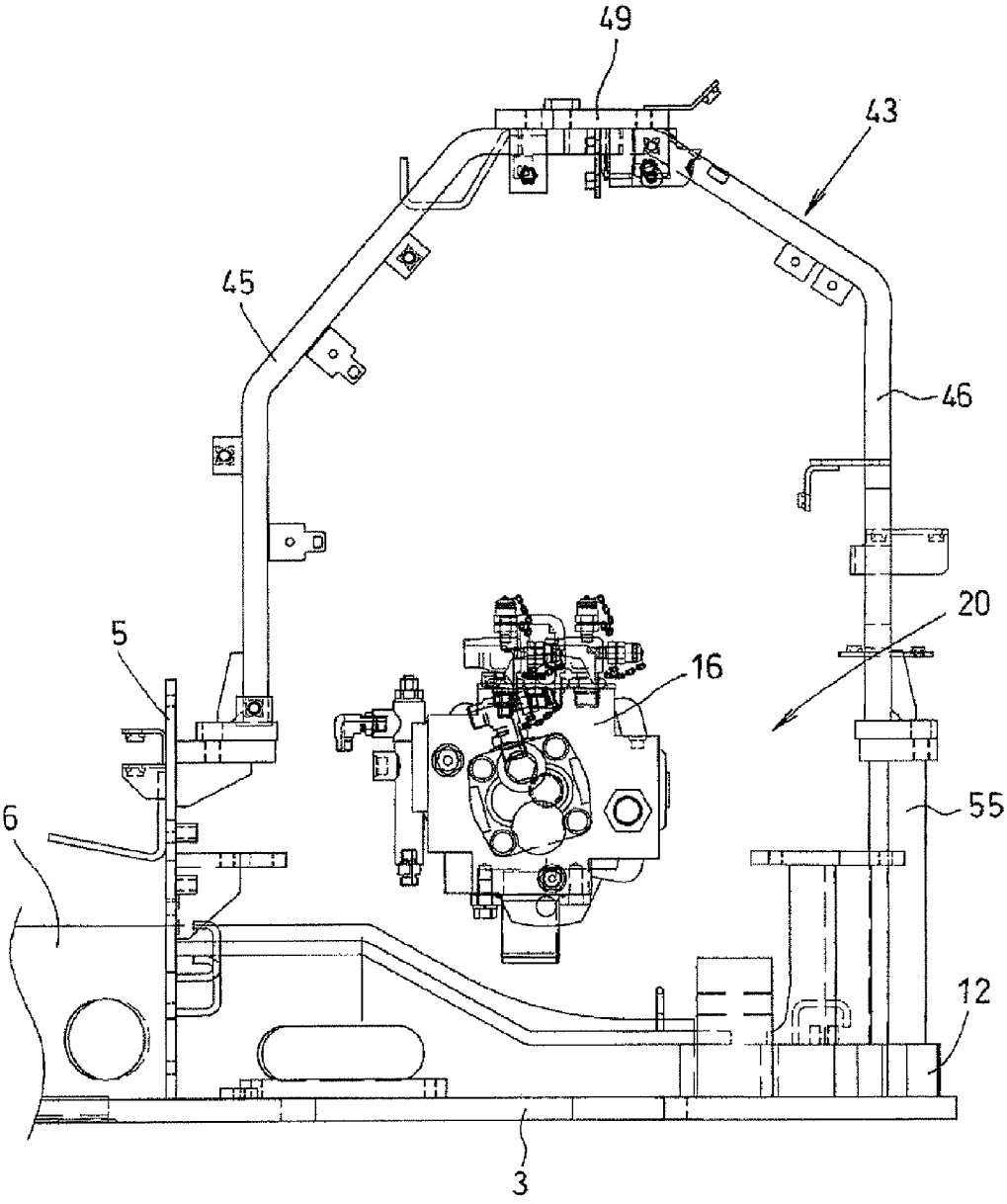
FIG. 3 is a left side view of a portion of a rear bonnet of the swivel stage.
Figure 4:
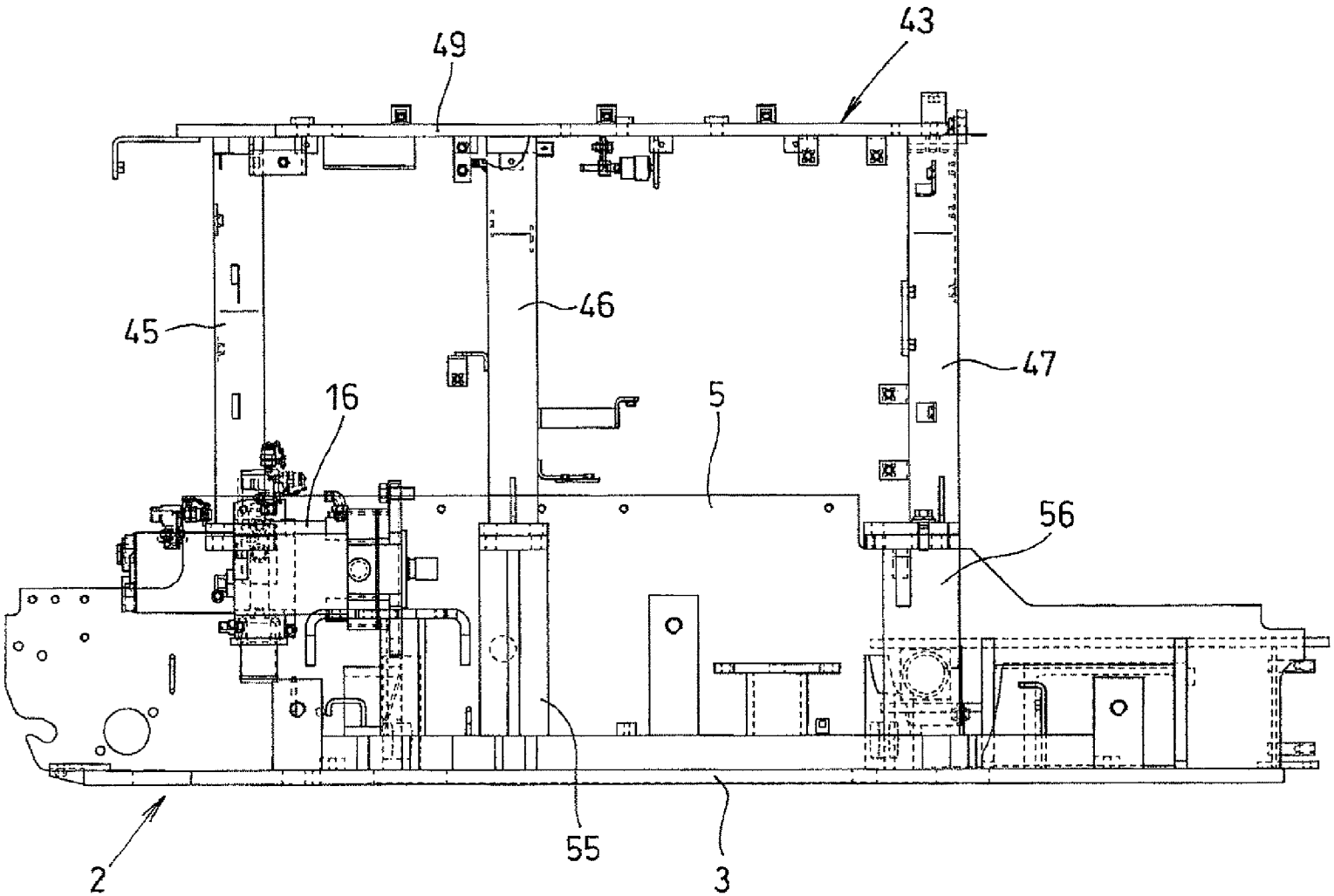
FIG. 4 is a rear view of a portion of the rear bonnet of the swivel stage.

As shown in FIGS. 1 and 2, on a front side of the vertical wall 5 of the swivel stage 2 and the front cover 22, an operation part is provided that has a driver's seat 38 and steering levers. On the front cover 22, a canopy 39 for protecting the driver's seat 38 (operation part) stands.

As shown in FIGS. 2 to 8, a support frame 43 is provided on the rear portion of the swivel stage 2. The support frame 43 straddles the engine 14 thereabove. The support frame 43 is formed mainly of a left-front leg 45, a left-rear leg 46, a right-rear leg 47, a right-front leg 48 (not shown), a lateral support plate 49 and a longitudinal support plate 50. The lateral support plate 49 is connected to upper end portions of the legs 45,46,47, and the longitudinal support plate 50 protrudes frontward from a right end portion of the lateral support plate 49, and the right-front leg 48 supports a front portion of the longitudinal support plate 50.

Lower ends of the left-front leg 45 and the right-front leg 48 are fixed to the swivel base 3 through the vertical wall 5 and the like. Lower ends of the left-rear leg 46 and the right-rear leg 47 are fixed to the swivel base 3 through mounting stages 55,56 and the like. The lateral support plate 49 is in a shape of a band extending in a transversal direction. A left end portion of the lateral support plate 49 and the upper end portion of the left-front leg 45 are connected and fixed to each other by welding or the like. An intermediate portion of the lateral support plate 49 in the transversal direction is connected and fixed to the upper end portion of the left-rear leg 46 by welding or the like. The right end portion of the lateral support plate 49 is connected and fixed to the upper end portion of the right-rear leg 47 by welding or the like. A rear end portion of the longitudinal support plate 50 is connected and fixed to the right end portion of the lateral support plate 49 and also to the upper end portion of the right-rear leg 47 by welding or the like.

As shown in FIGS. 5 to 8, the left cover 25 is supported by and fixed to the lateral support plate 49 of the support frame 43 through a mounting bracket 53 or the like. The right inner wall cover 26 is supported and fixed to the lateral support plate 49 through a mounting bracket or the like. The right cover 28 is supported by the longitudinal support plate 50 of the support frame 43 through a hinge, in such a manner that the right cover 28 is freely opened and closed about a shaft extending in the longitudinal direction. The upper wall 33 of the front cover 22 is positioned right above the lateral support plate 49, and fixed to the lateral support plate 49 with fixtures, such as bolt and nut.

As shown in FIGS. 6 to 8, 13 and 16, a plurality of fixing pieces 59 protrude rearward from the lateral support plate 49, and are arranged at predetermined intervals in the transversal direction. Each of these fixing pieces 59 includes a mounting base 59*a* which is a horizontal front side portion, and an inclined fixing portion 59*b* which is a rear side portion sloping upward toward the rear. A rear portion of the upper wall 33 of the front cover 22 is positioned above the fixing pieces 59, and a rear end portion of the upper wall 33 is fixed to the inclined fixing portions 59*b* with fixtures 60, such as bolt. It should be noted that the rear end portion of the upper wall 33 is formed as an inclined part 33*a* sloping upward toward the rear so as to correspond to the slope of the inclined fixing portion 59*b*.

Figure 13:
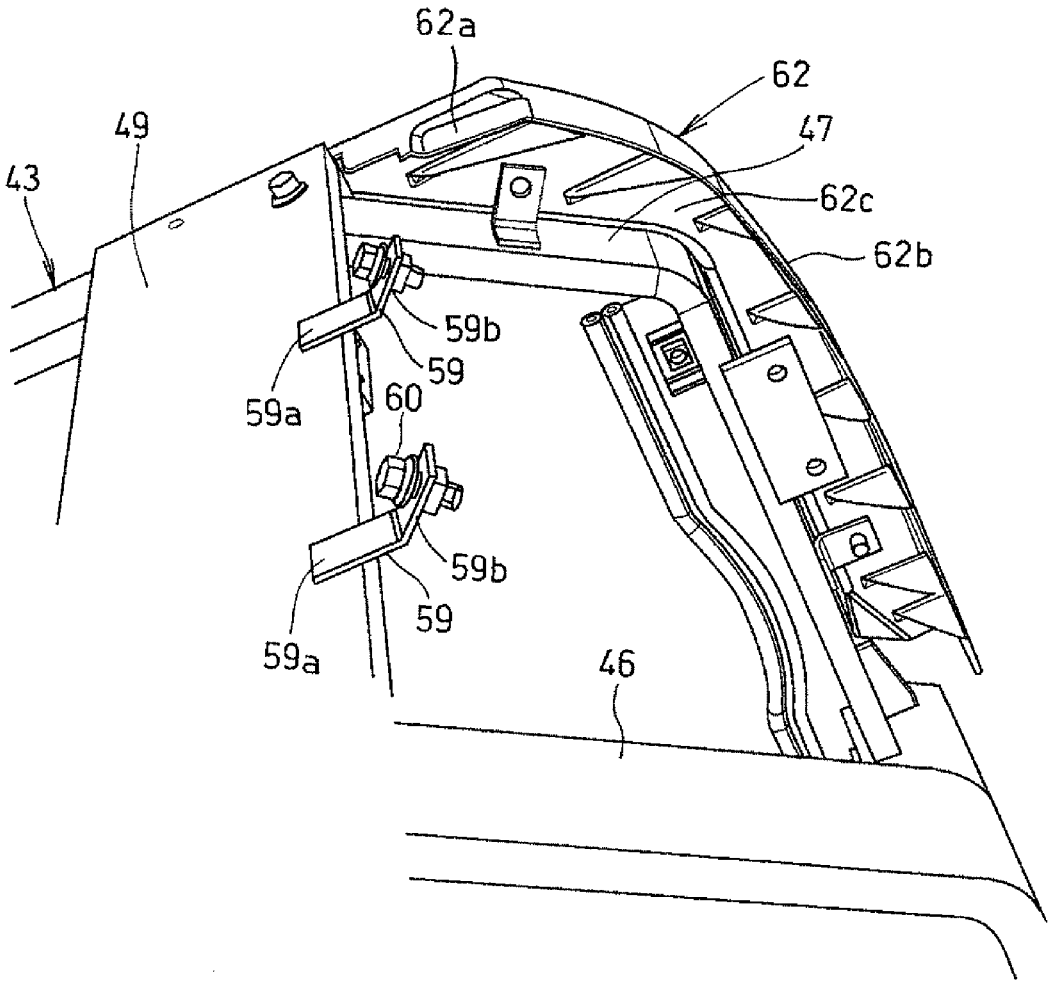
FIG. 13 is a perspective view of a portion of a partition cover of the swivel stage.

As shown in FIGS. 5 and 13, a partition cover 62 is fixed to the right-rear leg 47 of the support frame 43, so as to, extend along a right end (free end in the transversal direction) of the rear cover 24. The partition cover 62 is configured to separate a space around the radiator 15 into an upstream-side space and a downstream-side space in terms of an air flow direction. The partition cover 62 separates a space on a rear side of the radiator 15 into a right space and a left space, by extending along a rear portion of a periphery of the radiator 15. With respect to separation of other spaces around the radiator 15, i.e., spaces on a front side, on a right side and on a left side, other partition covers or the like (not shown) are used.

As shown in FIGS. 5, 7, 8, 11 and 12, the rear cover 24 includes: a cover main body 64; and an upper cover body 65 fixed to an upper end portion of the cover main body 64 in such a manner that the upper cover body 65 protrudes frontward. The cover main body 64 includes: a rear wall 64*a*; and a mounting rim 64*b* frontward protruding from an upper end of the rear wall 64*a*. The rear wall 64*a*, when seen from above, is curved in a shape of an arc with an intermediate portion in the transversal direction swelling rearward and a right and left end portions jutting frontward. At the same time, an upper portion of the rear wall 64*a* is curved frontward. The upper cover body 65 includes: an upper wall 65*a*; a pair of right and left side walls 65*b* extending downward from corresponding lateral ends of the upper wall 65*a*; and a rear wall 65*c* extending downward from a rear end of the upper wall 65*a*. A rear portion (rear wall 65*c*) of the upper cover body 65 is mounted on the mounting rim 64*b* of the cover main body 64 and fastened with fastenings, such as bolt, in such a manner that the upper cover body 65 is detachable from the cover main body 64.

As shown in FIGS. 7 to 10 and 12, on an inner face of a left end portion of the cover main body 64 (the rear cover 24), a mounting member 68 in a square U-shape is provided, with an opening thereof facing the cover main body 64. To the mounting member 68, a supporting member 69 is fixed with fixtures, such as bolt. To a protruding end of the supporting member 69, a pair of upper and lower support cylinders 70 are attached. On a left end portion of the lateral support plate 49, a squared U-shaped support bracket 72 is provided while protruding rearward from the lateral support plate 49, to which an upper support 73 is fixed with fixtures, such as bolt. The upper support 73 is connected to a connecting body 75 through a lower support 74. Between the upper support 73 and the lower support 74, a vertical shaft 77 is provided. The vertical shaft 77 is inserted into the pair of upper and lower support cylinders 70 relatively rotatably about a shaft center thereof. With this configuration, the rear cover 24 is supported by the support frame 43 in such a manner that the rear cover 24 is freely opened and closed about the vertical shaft 77 as a fulcrum shaft on a left end of the rear cover 24 (hereinafter, frequently referred to as "open-close cover 24").

On an inner face of a right end portion of the rear cover 24, a lock mechanism 79 is provided. The lock mechanism 79 is configured to be automatically engaged with an engaging portion provided on the support frame 43 when the rear cover 24 is closed, in such a manner that the rear cover 24 is releasably held in a locked state.

Figure 11:
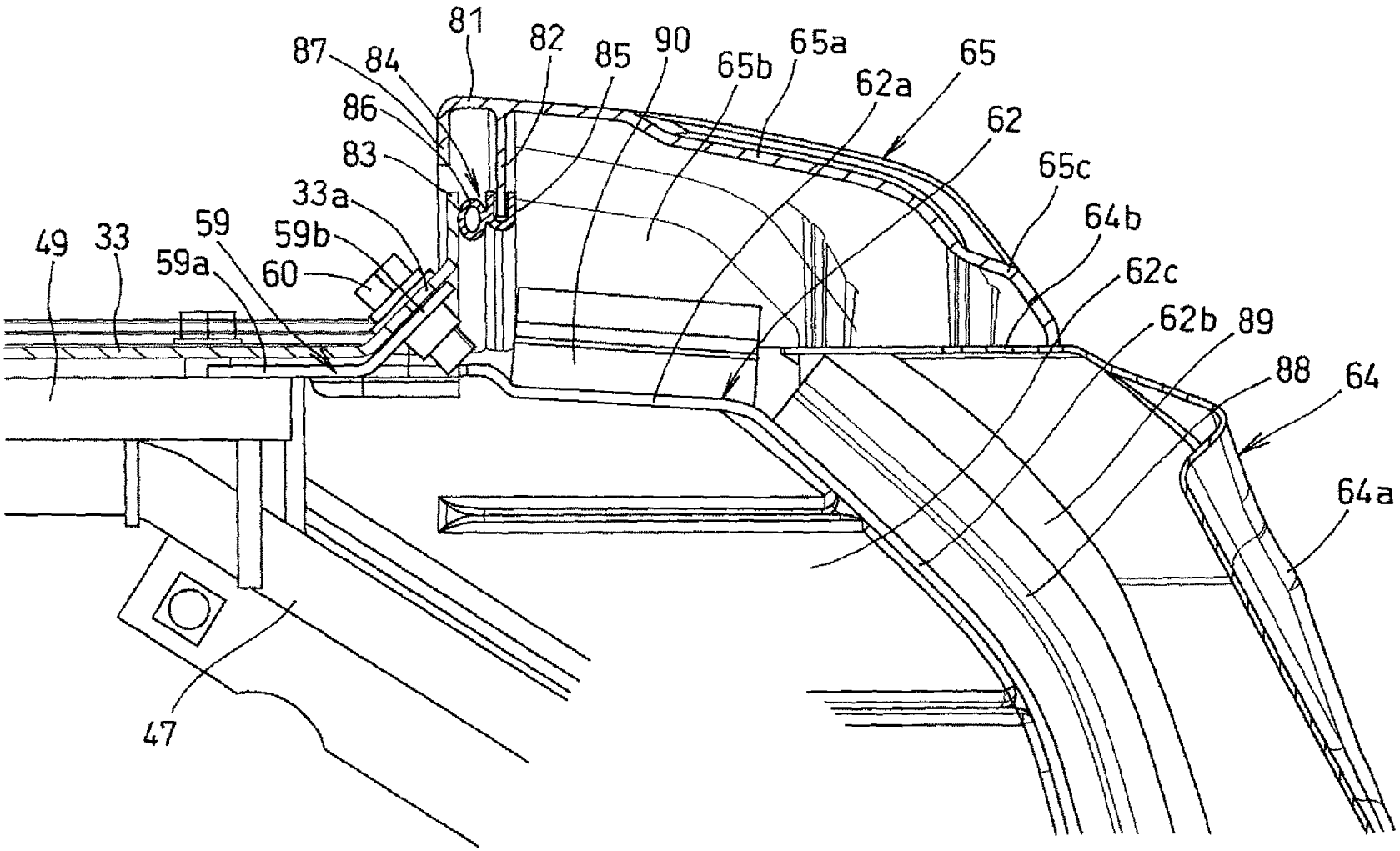
FIG. 11 is a longitudinal cross section of a portion of the rear cover of the swivel stage.
Figure 12:
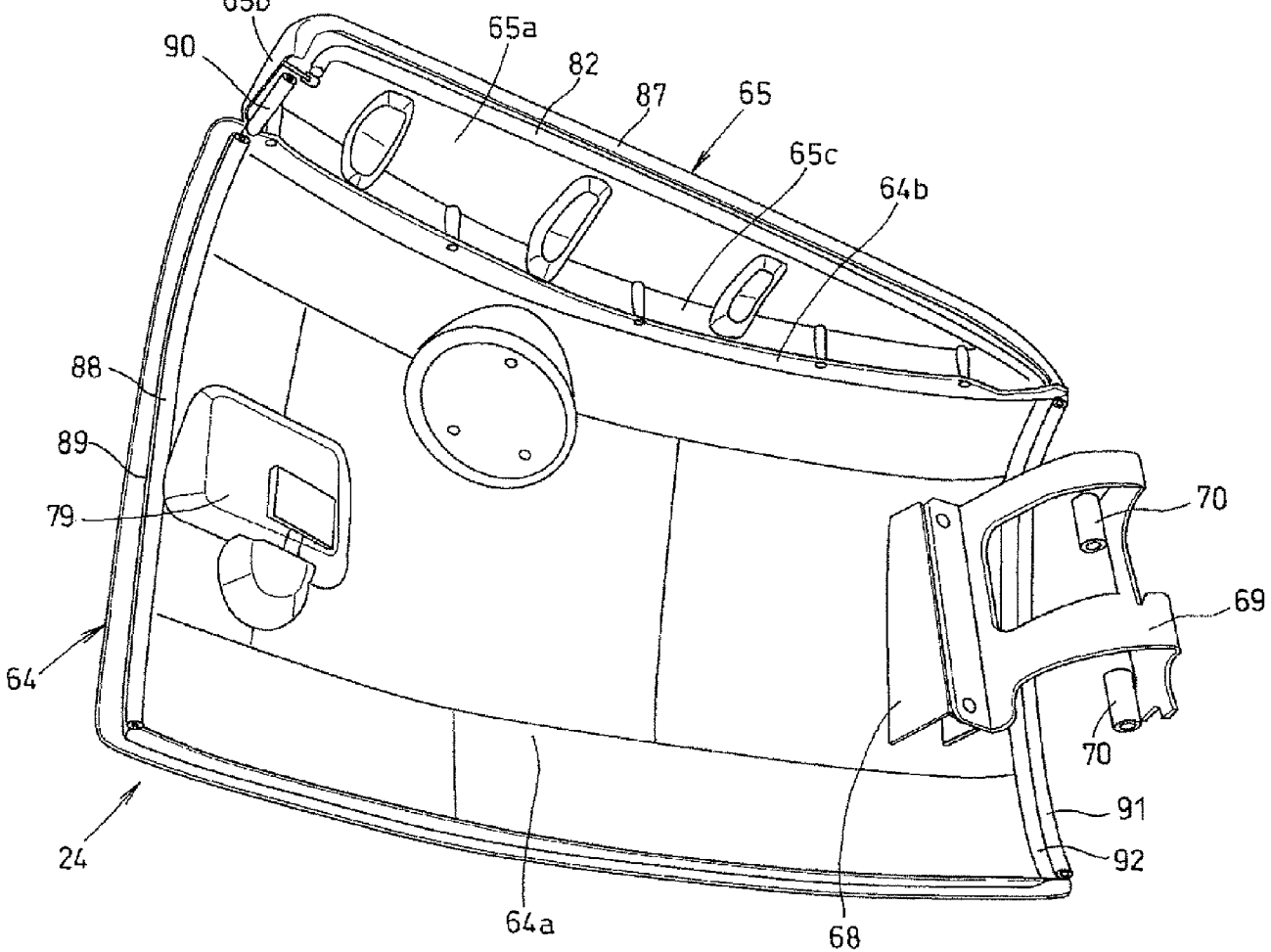
FIG. 12 is a perspective view of the rear cover.

As shown in FIGS. 11 and 12, from the upper wall 65*a* of the upper cover body 65 (the rear cover 24), a cover piece 81 protrudes frontward. On the cover piece 81, a suspended piece 82 is provided that protrudes downward from a base portion of the cover piece 81. On the upper wall 33 of the front cover 22 (an upper end of the inclined part 33*a* of the upper wall 33), a standing piece 83 is provided that stands opposite to the suspended piece 82, when the rear cover 24 is closed. The standing piece 83 is positioned below the cover piece 81, when the rear cover 24 is closed. On the suspended piece 82, a sealing member 84 is attached so as to be brought into contact with the standing piece 83, when the open-close cover 24 is closed. The sealing member 84 spans a nearly entire length of the rear cover 24 in the transversal direction. In addition, the sealing member 84 includes a fixing portion 85 having a U-shaped cross-section and a cylindrical contacting portion 86, with the fixing portion 85 being fitted onto and fixed to a lower portion of the suspended piece 82 from a bottom side. The sealing member 84 is configured to make a seal between an upper end portion of the rear cover 24 and an upper end portion of the front cover 22 along a nearly entire length in the transversal direction, by pressing and bringing the contacting portion 86 of the sealing member 84 into a close contact with the standing piece 83, when the rear cover 24 is closed.

On a protruding end portion (front end portion) of the cover piece 81, there is provided a downward protrusion 87 in such a manner that the standing piece 83 is positioned below the cover piece 81 and on a suspended piece 82 side (rear side) relative to the downward protrusion 87, when the rear cover 24 is closed.

The cover piece 81 protrudes frontward further in the longitudinal direction than a front end of the sealing member 84, or protrudes frontward to approximately the same level in the longitudinal direction as the front end of the sealing member 84. When the rear cover 24 is closed and the sealing member 84 is elastically deformed rearward relative to the cover piece 81 by being pressed to the upper end portion (the standing piece 83) of the front cover 22, the cover piece 81 is located above the sealing member 84 and reaches a position above the upper wall 33 of the front cover 22 (the standing piece 83 or the rear end portion of the upper wall 33).

On a free end portion of the upper cover body 65 (a lower end portion of a right side wall 65*b*), there is provided an upper sealing member 90 which is brought into contact with a top wall 62*a* of the partition cover 62 when the rear cover 24 is closed, while on a free end portion of the cover main body 64 (the right end portion of the rear wall 64*a*), there is provided a rear sealing member 88 which is brought into contact with a rear wall 62*b* of the partition cover 62 through a protrusion 89 when the rear cover 24 is closed. On a base end portion of the cover main body 64 (left end portion of the rear wall 64*a*), a base end sealing member 91 is provided through a protrusion 92, which is configured to be brought into contact with a right end portion of the left cover 25 when the rear cover 24 is closed, to thereby make a seal between the left cover 25 and the rear cover 24.

Figure 14:
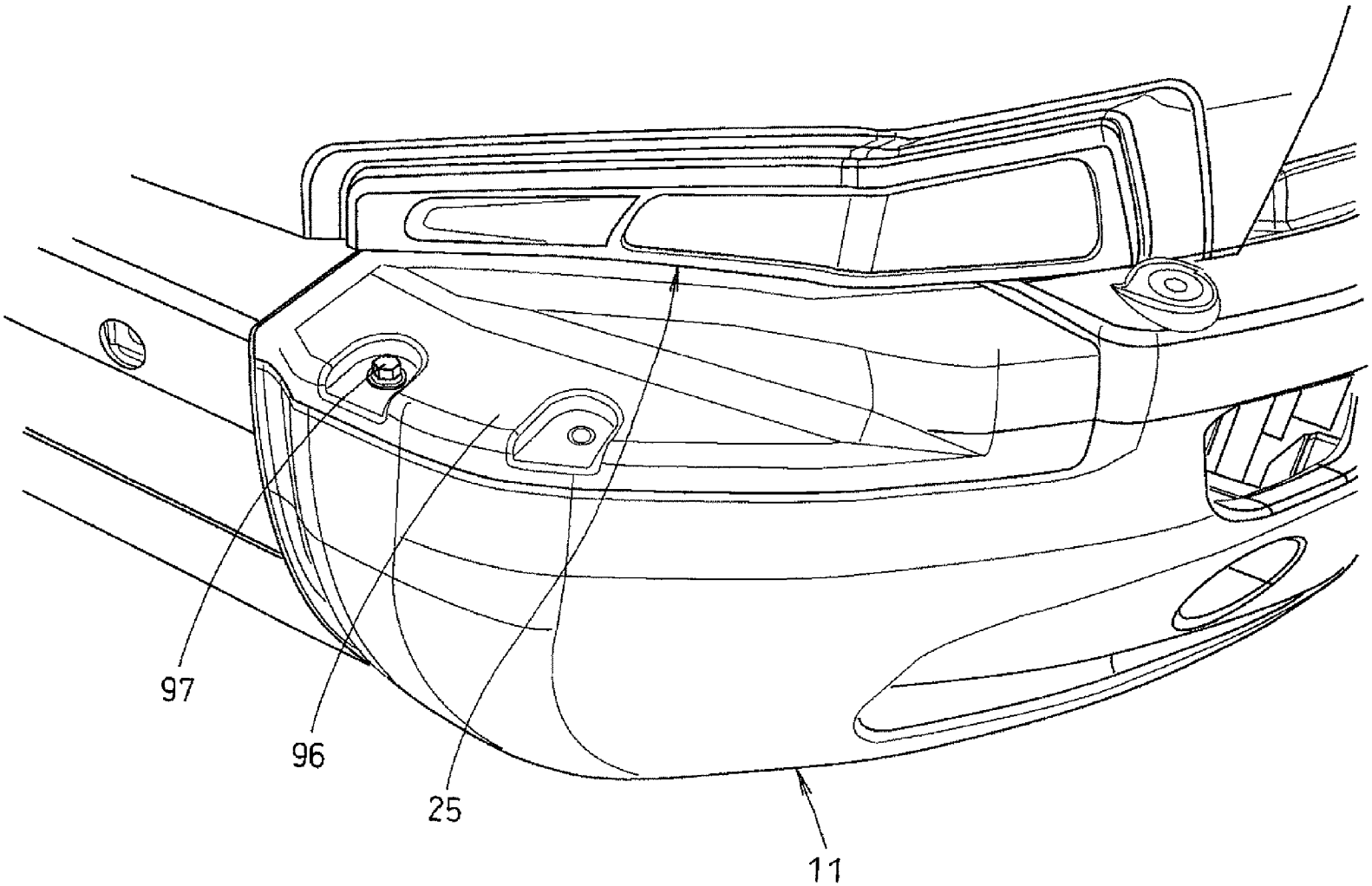
FIG. 14 is a perspective view of a left portion of a counter weight.
Figure 15:
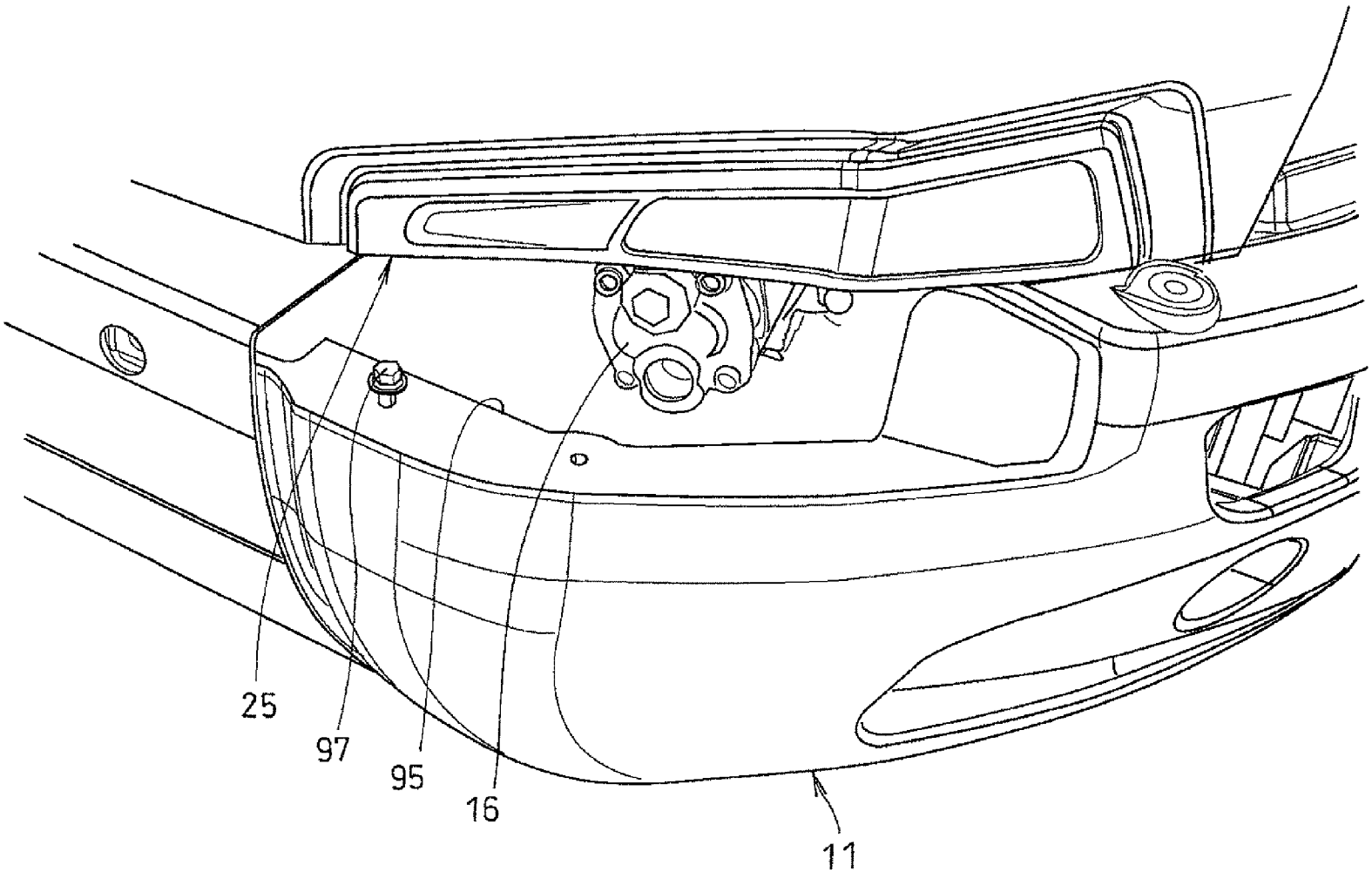
FIG. 15 is a perspective view of the left portion of the counter weight with a cover member removed.

As shown in FIGS. 1, 14 and 15, on a left upper portion of the counter weight 11, an opening window 95 is provided at a position corresponding to a position of the hydraulic pump 16, and a cover member 96 for closing the opening window 95 is detachably provided on the counter weight 11 with a fastening 97, such as bolt. Accordingly, when the hydraulic pump 16 is to be removed from the swivel stage 2 for the purpose of inspection or the like, it is not necessary to remove the entire counter weight 11, and simply removing the cover member 96 will suffice. It should be noted that the cover member 96 is made of synthetic resin or the like.

According to the above-described embodiment, when the rear cover 24 is rotated about the vertical shaft 77 to close the rear cover 24, the sealing member 84 on the upper cover body 65 is pressed and brought into a close contact with the standing piece 83 on the front cover 22, to thereby make a seal between the upper end portion of the rear cover 24 and the upper end portion of the front cover 22 along a nearly entire length in the transversal direction. In this situation, the standing piece 83 is positioned below the cover piece 81 and on the suspended piece 82 side (rear side) relative to the downward protrusion 87, and the cover piece 81 is located above the sealing member 84 and reaches a position above the upper wall 33 of the front cover 22 (a standing piece 83 or rear end portion of the upper wall 33). Therefore, even when it snows on the rear bonnet 36, or even when soil lifted during excavation work or the like drops on the rear bonnet 36, the cover piece 81 and the downward protrusion 87 can protect an upper side of the sealing member 84, and thus prevent snow and soil from accumulated on the sealing member 84. Accordingly, snow or soil is prevented from being accumulated on the sealing member 84 or portions of the cover in the vicinity thereof, and thus the sealing member 84 and portions of the cover in the vicinity thereof are prevented in advance from becoming fixed in an attached state which may otherwise be caused by frozen snow or soil.

In addition, when the rear cover 24 is closed, the upper sealing member 90 on the free end portion of the upper cover body 65 (a lower end portion of a right side wall 65*b*) is brought into contact with the top wall 62*a* of the partition cover 62, and at the same time, the rear sealing member 88 on the free end portion (a right end portion of a rear wall) of the cover main body 64 is brought into contact with the rear wall 62*b* of the partition cover 62, to thereby make a seal between the rear cover 24 and the partition cover 62. The base end sealing member 91 on the base end portion of the cover main body 64 (left end portion of the rear wall 64*a*) is brought into contact with the right end portion of the left cover 25, to thereby make a seal between the left cover 25 and the rear cover 24.

Figure 16:
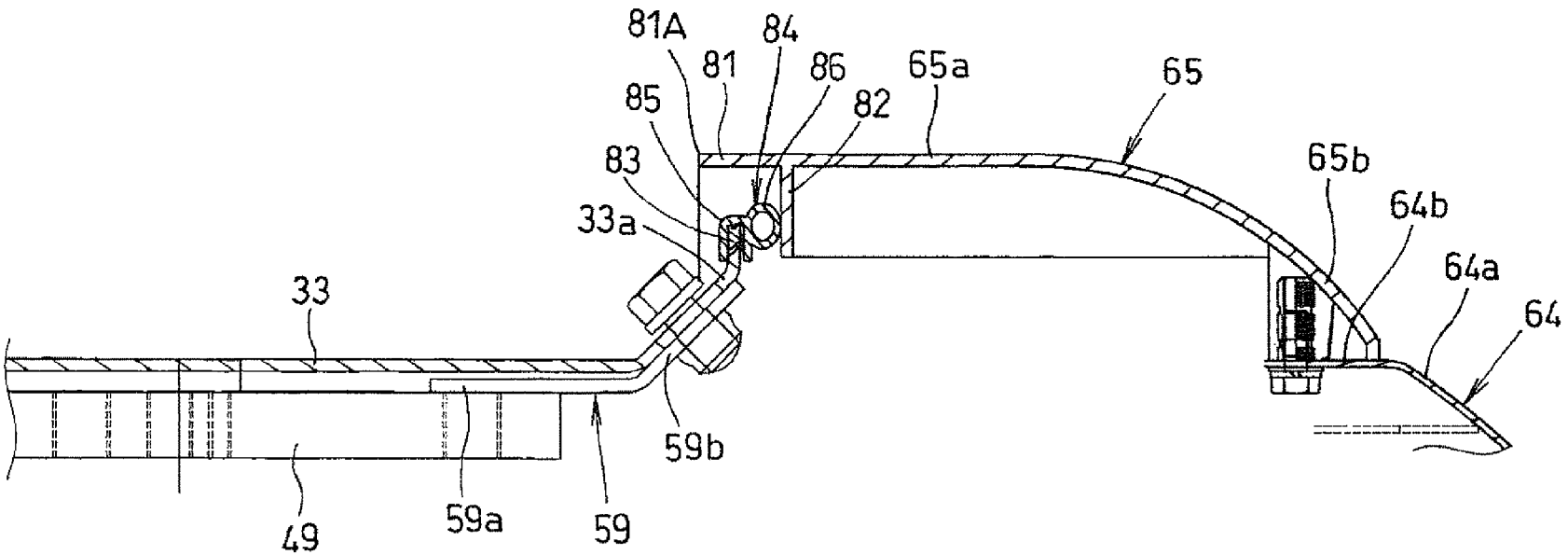
FIG. 16 is a longitudinal cross section of a portion of a rear cover of a swivel stage according to another embodiment.

FIG. 16 shows another embodiment in which the sealing member 84 is provided on an upper end portion of the standing piece 83 of the front cover 22. When the rear cover 24 is rotated about the vertical shaft 77 to close the rear cover 24, the sealing member 84 on the standing piece 83 is pressed and brought into a close contact with the suspended piece 82 on the rear cover 24, to thereby make a seal between the upper end portion of the rear cover 24 and the upper end portion of the front cover 22 along a nearly entire length in the transversal direction. In this situation, the standing piece 83 is positioned below the cover piece 81 and on the suspended piece 82 side (rear side) relative to a tip portion 81A of the cover piece 81, and the cover piece 81 is located above the sealing member 84 and reaches a position above the upper wall 33 of the front cover 22 (the standing piece 83 or the rear end portion of the upper wall 33). Other features are substantially the same as those described in the above-mentioned embodiment, and thus the descriptions are omitted.

It should be noted that, in the above-described embodiments illustrated in FIGS. 11 and 16, the cover piece 81 protrudes from the upper wall 65*a* of the open-close cover 24, so as to be located above the sealing member 84 and reach a position above the upper wall 33 of a fixed cover 22, when the open-close cover 24 is closed. Accordingly, when the rear bonnet 36 is seen from behind, a step between the open-close cover 24 and the fixed cover 22 is covered with the cover piece 81 and the like, which makes a shape of the rear bonnet 36 simpler and contributes to an excellent appearance. Instead, the cover piece 81 may protrude from the upper wall 33 of the fixed cover 22, so as to be located above the sealing member 84 and reach a position above the upper wall 65*a* of the open-close cover 24, when the open-close cover 24 is closed.

Also in the above-described embodiments illustrated in FIGS. 11 and 16, the cover piece 81 is provided on the upper wall 65*a* of the open-close cover 24, the suspended piece 82 downward protrudes from the base portion of the cover piece 81, and the standing piece 83 is provided on a rear end portion of the upper wall 33 of the fixed cover 22, that stands opposite to the suspended piece 82. Instead, the cover piece 81 may be provided on the upper wall 33 of the fixed cover 22, the suspended piece 82 may downward protrude from the base portion of the cover piece 81, and the standing piece 83 is provided on a front end portion of the upper wall 65*a* of the open-close cover 24, that stands opposite to the suspended piece 82. In addition, in this case, the sealing member 84 may be attached to the suspended piece 82, or alternatively, to the standing piece 83.

Moreover, in the embodiments described above, the rear cover 24 to be opened and closed is supported openably and closably about the vertical shaft 77 as a fulcrum shaft on the left end portion in the transversal direction of the rear cover 24. Instead, the rear cover 24 to be opened and closed may be supported openably and closably about the vertical shaft 77 as a fulcrum shaft on the right end portion in the transversal direction.

Also in the embodiments described above, the front cover 22 is a fixed cover and the rear cover 24 is an open-close cover, and when the rear cover 24 is closed, the upper end portion of the rear cover 24 is brought into contact with the upper end portion of the front cover 22 through the sealing member 84. However, the fixed cover is not limited to the front cover 22, and the open-close cover is not limited to the rear cover 24. For example, the left cover 25 may be a cover to be opened and closed, and the front cover 22 may be a cover to be fixed. In this case, the left cover 25 is made openable and closable about the vertical shaft 77, to thereby bring an upper end portion of the left cover 25 into contact with the upper end portion of the front cover 22 through the sealing member 84, when the left cover 25 is closed.

What is claimed is:

1. A bonnet sealing structure for a swiveling work machine comprising:

a bonnet configured to cover an engine provided on a swivel stage including:

a fixed cover, and an open-close cover which is swingably supported about a vertical shaft and is openable and closable relative to the fixed cover;

a sealing member through which an upper end portion of the open-close cover is brought into contact with an upper end portion of the fixed cover when the open-close cover is closed; and a cover piece protruding from one of an upper wall of the open-close cover and an upper wall of the fixed cover, wherein when the open-close cover is closed, the cover piece is located above the sealing member and reaches a point above the other of the upper wall of the fixed cover and the upper wall of the open-close cover.

2. The bonnet sealing structure according to claim 1, wherein the cover piece is provided on the upper wall of the open-close cover, and is provided with a suspended piece protruding downward from a base portion of the cover piece, a standing piece is provided on an end portion of the upper wall of the fixed cover, that stands opposite to the suspended piece and is positioned below the cover piece when the open-close cover is closed, and the sealing member is provided on one of the suspended piece and the standing piece, and is brought into contact with the other of the suspended piece and the standing piece when the open-close cover is closed.

3. The bonnet sealing structure according to claim 2, wherein the engine and a radiator are mounted on a rear portion of the swivel stage, a support frame straddles the engine, the fixed cover configured to cover upper and front sides of the engine is fixed to the support frame, the open-close cover configured to cover a rear side of the engine is supported by the support frame in such a manner that the open-close cover is freely opened and closed about the vertical shaft as a fulcrum shaft on one end in a transversal direction of the open-close cover, the open-close cover comprises a cover main body; and an upper cover body which is fixed to an upper end portion of the cover main body and protrudes frontward, and the upper cover body includes the upper wall on which the cover piece and the suspended piece are provided.

4. The bonnet sealing structure according to claim 3, wherein a partition cover configured to separate a space around the radiator into an upstream-side space and a downstream-side space in terms of an air flow direction is fixed to the support frame so as to extend along a free end portion in the transversal direction of the open-close cover, the partition cover comprises:

a top wall; and a rear wall protruding downward from a rear end of the top wall, on a free end portion of the upper cover body, an upper sealing member is provided which is brought into contact with the top wall of the partition cover when the open-close cover is closed, and on a free end portion of the cover main body, a rear sealing member is provided which is brought into contact with the rear wall of the partition cover when the open-close cover is closed.

5. The bonnet sealing structure according to claim 4, wherein a downward protrusion protrudes downward from a protruding end portion of the cover piece, and the standing piece is positioned below the cover piece and on a suspended piece side relative to the downward protrusion, when the open-close cover is closed.

6. The bonnet sealing structure according to claim 1, wherein the sealing member is provided at one of the open-close cover and the fixed cover where the cover piece is not provided.

* * * * *